US007196714B2

(12) United States Patent
Someno

(10) Patent No.: US 7,196,714 B2
(45) Date of Patent: Mar. 27, 2007

(54) PRINTER, PRINT CONTROL UNIT, PRINT CONTROL METHOD AND PRINT CONTROL PROGRAM PRODUCT

(75) Inventor: Masahiro Someno, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 197 days.

(21) Appl. No.: 10/948,394

(22) Filed: Sep. 24, 2004

(65) Prior Publication Data

US 2005/0141942 A1 Jun. 30, 2005

(30) Foreign Application Priority Data

Sep. 24, 2003 (JP) ..... 2003-332150
Sep. 17, 2004 (JP) ..... 2004-270765

(51) Int. Cl.
*B41J 2/315* (2006.01)

(52) U.S. Cl. ..... 347/212; 347/96; 347/100; 347/101

(58) Field of Classification Search ..... None
See application file for complete search history.

(56) References Cited

U.S. PATENT DOCUMENTS 6,533,382 B1 * 3/2003 Tomida et al. ..... 347/15
6,877,850 B2 * 4/2005 Ishimoto et al. ..... 347/100

FOREIGN PATENT DOCUMENTS

EP 1101619 * 5/2001

* cited by examiner

*Primary Examiner*—Daniel J. Colilla
*Assistant Examiner*—Marissa Ferguson-Samreth
(74) *Attorney, Agent, or Firm*—Sughrue Mion PLLC

(57) ABSTRACT

Quality of printing is easily improved without applying surface finishing after printing. A printer that prints an image based on image data, on a print medium, using a plurality of color inks. The printer comprises a colorless clear ink printing means which prints the print medium using a colorless clear ink, a print setting receiving means which receives settings relating to printing, and an area determination means which determines an area in which the colorless clear ink is used, based on at least either said image data or said settings relating to printing.

14 Claims, 7 Drawing Sheets

PRINTER, PRINT CONTROL UNIT, PRINT CONTROL METHOD AND PRINT CONTROL PROGRAM PRODUCT

BACKGROUND OF THE INVENTION

The present invention relates to a printing system, and in particular to a printing system that improves print quality easily without carrying out surface finishing after printing.

Ink-jet printers which is provided with an ink cartridge filled with ink and performs printing by blowing the ink onto a print medium such as printing paper or the like are widely used. In particular, color ink-jet printers provided with multi-color ink cartridges are widely used.

In the beginning, a color ink-jet printer used inks of four colors, i.e., three colors, yellow (Y), magenta (M) and cyan (C), called the three primary colors, and black (K) used for beautiful printing of black and saving of total quantity of the inks. Such a printer realizes full color by pseudo colors shown by combinations of dots of the respective ink colors. Since then, ink-jet printers have advanced in high quality printing. Now ink-jet printers in the mainstream are ones that perform printing using six or seven color inks including light color inks, as a result of trying to realize printing improved in color gradation and reduced granular feeling caused by dots.

By the way, in commercial printing for example, surface finishing is frequently carried out after printing, to improve quality of printed matter. Typical surface finishing is treatment called varnishing in which an oily, aqueous or UV varnish is coated on a surface of paper after print and then dried. Varnishing can make printed matter glossy or abrasion-resistant.

SUMMARY OF THE INVENTION

Usually, an ink-jet printer uses a white print medium such as white printing paper. Further, generally, ink colors used in a printer cannot show a white color. Accordingly, white parts of an image to be printed are made to show white by leaving the ground color of the print medium without jetting out ink onto those parts of the image. As a result, when image data such as a photographic image including white parts are printed, sometimes ink-jetted parts and ground parts of paper are mixed with one another, causing lack of uniformity in the gloss.

Further, ink jetted out at the time of printing is fixed on the surface of paper. Thus, sometimes, printed parts are subject to friction between sheets of paper or with hands of a user, depending on a state of use, and the printed parts blur and fade.

When surface finishing such as varnishing is applied also to an article printed by an ink-jet printer, then these problems are solved. However, surface finishing such as varnishing requires dedicated appliances, and costs money and work. In particular, generally an ink-jet printer is used for personal or household purposes, and thus, it is not realistic to carry out surface finishing after printing to improve quality of a printed article.

An object of the present invention is to improve quality of printed matter easily without carrying out surface finishing after printing in a printing system.

To solve the above problem, the present invention provides a print control method in a computer connected to a printer that prints an image based on print data, on a print medium, using a plurality of color inks and a colorless clear ink, wherein:

the print control method comprises:

an image data input step in which image data are inputted;

a print setting receiving step in which settings relating to printing are received; and a print data generation step in which print data to be outputted to the printer are generated based on the image data; and the print data generation step determines an area for applying the colorless clear ink based on at least one of the image data and the settings relating to printing.

Namely, according to the present invention, printing is performed using a colorless clear ink in addition to the conventional group of inks. As a result, quality of printing is easily improved without carrying out surface finishing after printing. Here, an area in which the colorless clear ink is applied can be determined by considering an instruction from a user.

Namely, the print setting receiving means can receive: a setting that defines printing without applying the colorless clear ink; a setting that defines printing in which a print area for applying color inks is the area for applying the colorless clear ink; a setting that defines printing in which an entire surface of the print medium allowed for printing is the area for applying the colorless clear ink; a setting that defines printing in which an area corresponding to dot image data in the above-mentioned image data is the area for applying the colorless clear ink; a setting that defines printing an area that corresponds to dot image data in the above-mentioned image data of which the color inks are not applied is the area for applying the colorless clear ink. For these settings, an acceptable setting for area to apply the colorless clear ink could be changed in accordance with types and quality of print medium received, once the settings of the type of print medium and quality of printing are received.

Concretely, it is possible to accept a print setting of which the colorless clear ink is applied on an area for applying the color inks, when the print medium is a plain paper. On the other hand, it is possible to accept a print setting of which the colorless clear ink is applied on an area corresponding to dot image data in the above-mentioned image data, when the print medium in a glossy paper.

In the case of plain paper, when the colorless clear ink is applied over the area applied with color inks, it is possible to improve abrasion resistance. On the other hand, in the case of the glossy paper, when the colorless clear ink is applied over the area of the dot image, it is possible to increase the chroma (vividness).

DETAILED DESCRIPTION OF THE PREFERRED EMBODIMENTS

Embodiments of the present invention will be described referring to the figures.

Figure 1:
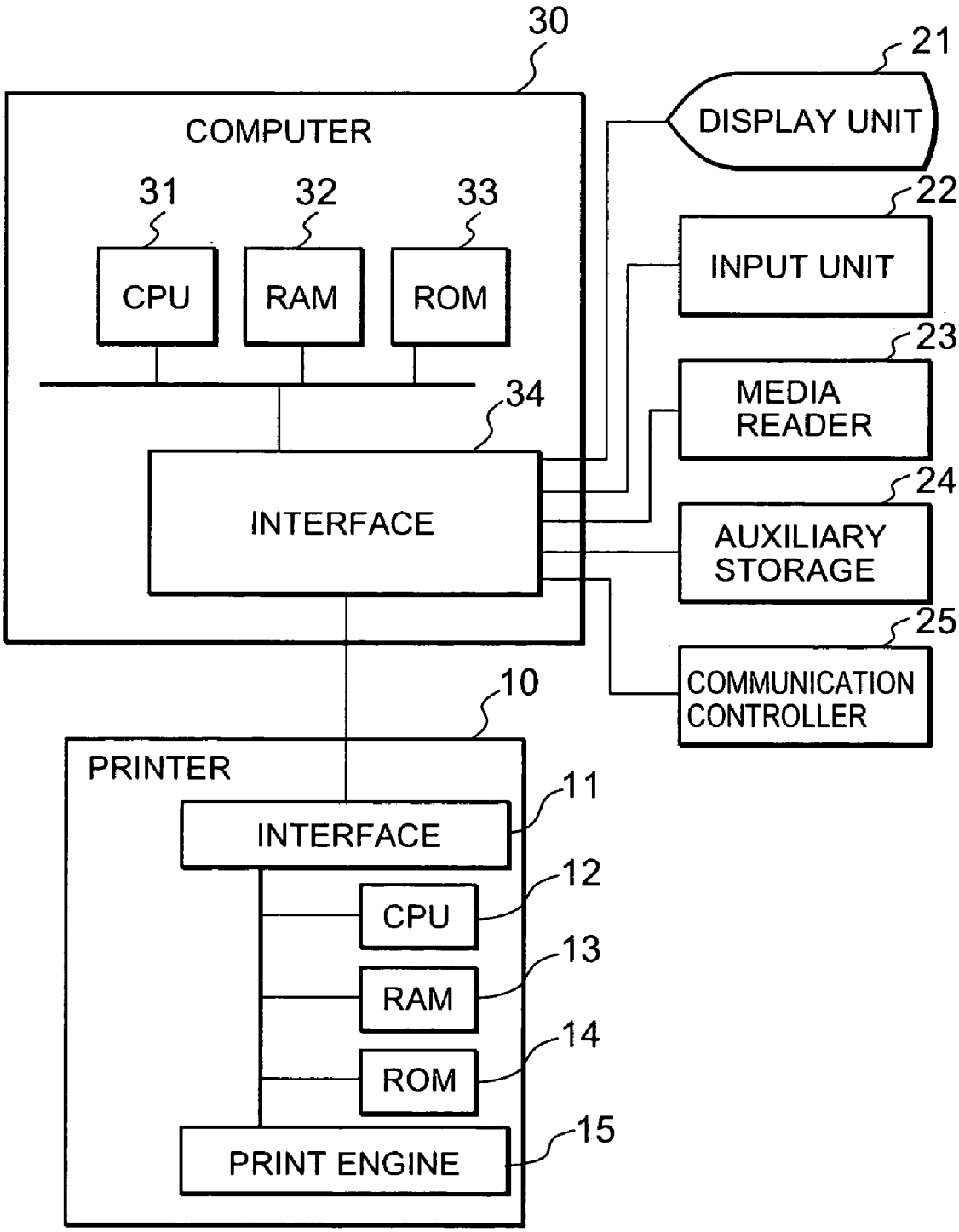
FIG. 1 is a block diagram for explaining an outline of a hardware configuration of a printing system.

FIG. 1 is a block diagram for explaining an outline of a hardware configuration of a printing system to which the present invention is applied.

As shown in the figure, the printing system comprises: a computer 30 for executing various kind of processing by applications and print processing and the like by a printer driver; and a printer 10 connected to the computer 30. In the present embodiment, the computer 30 functions as a print control unit that generates print data and sends the print data to the printer 10. The printer 10 performs printing based on print data received from the computer 30. Or, the printer 10 may be provided with a print control function, to make a printing system.

The computer 30 comprises a CPU (Central Processing Unit) 31 for executing processing based on various programs; a RAM (Random Access Memory) 32 for temporarily storing data, programs and the like; a ROM (Read Only Memory) 33 for previously storing, in a nonvolatile manner, various data used for controlling the computer 30 and programs to start up, and the like; and an interface 34 which manages sending and receiving data to and from peripheral devices such as the connected printer 10.

Further, through the interface 34, the computer 30 is connected with a display unit 21 such as a color display, an input unit 22 such as a mouse, a keyboard, or the like, a media reader 23 for reading data from a record medium such as a CD-ROM, a built-in or external auxiliary storage 24, and a communication controller 25 for connecting with a computer network such as Internet. However, the configuration of the computer 30 is not limited to this.

The printer 10 is, for example, an ink-jet color printer. An ink-jet color printer is provided with a plurality of ink cartridges each having a box member filled with ink, and performs printing by blowing the inks through a recording head onto a print medium such as recording paper or the like.

The printer 10 comprises: an interface 11 for managing communication with the computer 30; a CPU 12 for executing processing based on various programs; a RAM 13 for temporarily storing print data and the like; a ROM 14 for previously storing, in a nonvolatile manner, various programs and the like; and a print engine 15 comprising a print head for jetting out ink, a carriage drive for driving a carriage mounted with the print head, a paper driving mechanism, a paper feed/output mechanism for feeding and outputting a print medium, and the like. The configuration of the printer 10 is not limited to this.

Figure 2:
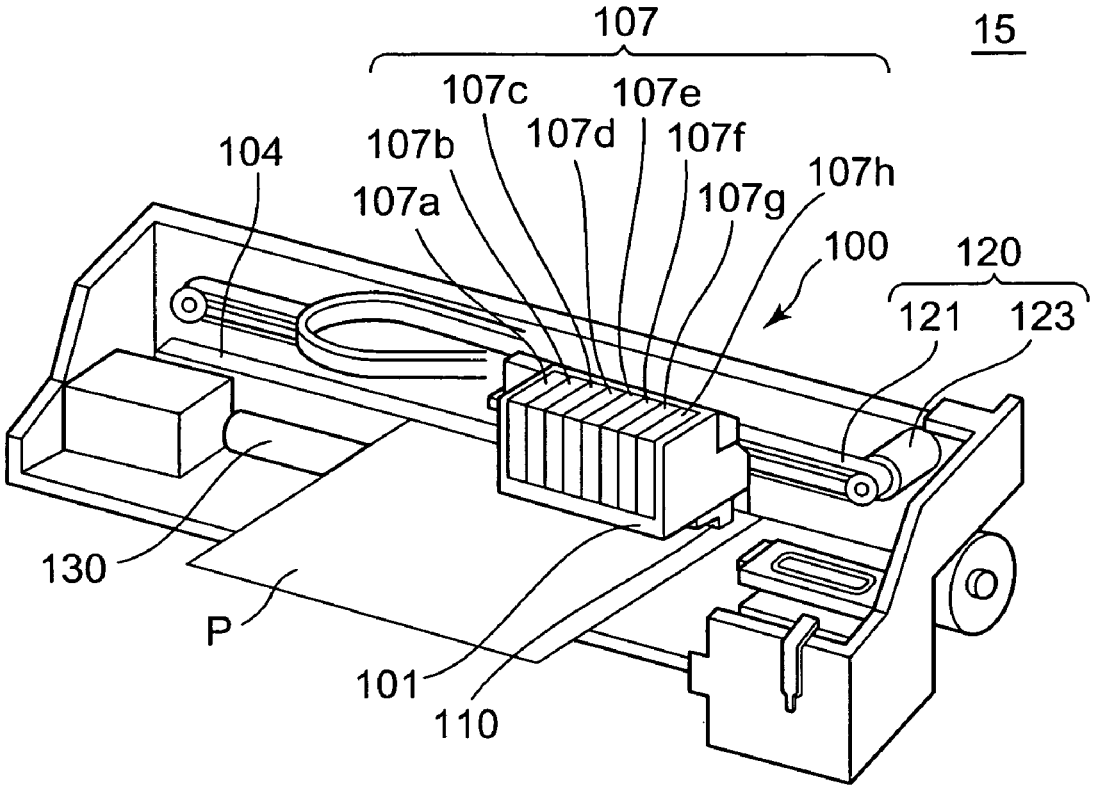
FIG. 2 is a perspective view showing a printer engine.

FIG. 2 is a view for explaining an outline of the configuration of the print engine 15. As shown in the figure, the print engine 15 comprises: the carriage 101 mounting a plurality of ink cartridges 107 (107*a*–107*h*); an ink-jet recording head 110 supported by the carriage 101; a carriage mechanism 120 that supports the carriage 101 and reciprocates the carriage 101 in the line direction; and the paper driving mechanism 130 for driving paper P.

The carriage mechanism 120 comprises a timing belt 121 interlocked with the carriage 101, and a carriage motor 123 for reciprocating the timing belt 121. The carriage motor 123 reciprocates the carriage 101 via the timing belt 121 such that the carriage 101 reciprocates in the width direction of the recording paper P, being guided by a guide member 104.

The carriage 101 is attached with the ink-jet recording head 110 on its surface facing the recording paper P, i.e., the bottom surface in the example shown. The recording head 110 is held on the carriage 101. The recording head 110 is supplied with inks from the ink cartridges 107 and jets out ink drops to form dots on the recording paper P synchronously with movement of the carriage 101, to print images, characters, and the like on the recording paper P.

The ink cartridges 107*a*–107*h* are independent of each other. Thus, when residual quantity of ink in one of the ink cartridges 107 runs out, it is possible to take out and replace only the ink cartridge 107 in question. The recording head 110 has nozzle openings (not shown) arranged in lines corresponding respectively to eight ink cartridges 107*a*–107*h*.

In the present embodiment, the eight ink cartridges 107*a*–107*h* are mounted on the carriage 101. Among the eight cartridges, seven cartridges are respectively filled with a black ink (K) and color inks, similarly to the conventional technique. The color inks may be cyan (C), light cyan (LC), magenta (M), light magenta (LM), yellow (Y) and dark yellow (DY), for example. However, ink colors are not limited to these. For example, instead of the magenta type inks, red type inks may be used.

And, the remaining one ink cartridge is filled with a colorless clear ink. The clear ink is used, for example, for conditioning the gloss to prevent lack of uniformity in the gloss. For example, a conventional ink, in particular a pigment ink removed of color components may be used as the clear ink. Further, preferably, the clear ink includes a resign component.

In detail, to improve the glossy property and the chromogenic property, preferable composition of the clear ink includes fine particles of polymer and not a color agent. As the polymer particles, may be mentioned: polymers containing a sulfonic group (sol-type resins); modified polypropylene emulsions; copolymers obtained by polymerizing ethleny unsaturated carboxylic acid monomers and other monomers that can be copolymerized with those monomers, in the presence of a water-soluble high molecular compound containing an alcoholic hydroxyl group or a copolymerizable surface active agent; emulsifiable resins having a particle diameter of 70 nm or more; and the like.

The black ink (K) and the color inks are used similarly to the conventional print processing. On the other hand, it may be determined based on a user's instruction whether the clear ink should be used in printing and, in the case of use, how the clear ink should be used. This will be described later.

Next, functional configurations attained for the computer 30 and the printer 10 in the above mentioned printing system will be described with reference to block diagram in FIG. 3.

As shown in the figure, an application part 310 and a printer driver part 320 are implemented on the computer 30.

The application part 310 has functions of making the computer 30 perform processing of a word processor, graphics, and the like, and is implemented on the computer 30 when the CPU 31 executes application programs loaded in the RAM 32.

The printer driver part 320 has functions of reading image data generated by the application part 310, converting the image data into print data of a format that can be interpreted by the printer 10, and sends the print data to the printer 10 through the interface 34.

For this reason, the printer driver part 320 comprises: an analysis processing part 320*a* for analyzing contents of image data in units of band; a rasterizer processing part 320*b* for expanding the image data into a set of dots; a halftone processing part 320*c* for performing color conversion processing and halftone processing; a binarization processing part 320*d* for converting color information into ON-OFF information of each ink for each dot; a command conversion processing part 320*e* for converting the processed image data into print data for controlling the printer 10; and a user interface part 320*f* for receiving print setting from a user.

The printer driver part 320 is implemented on the computer 30 when the CPU 31 executes a printer driver program loaded in the RAM 32. The printer driver program for this purpose can be distributed in the market, being recorded in a portable record medium such as a CD-ROM. Then, by reading the record medium with the media reader 23, it is possible to install the printer driver in the computer 30. Further, the printer driver may be installed through a computer network such as Internet, for example.

Figure 3:
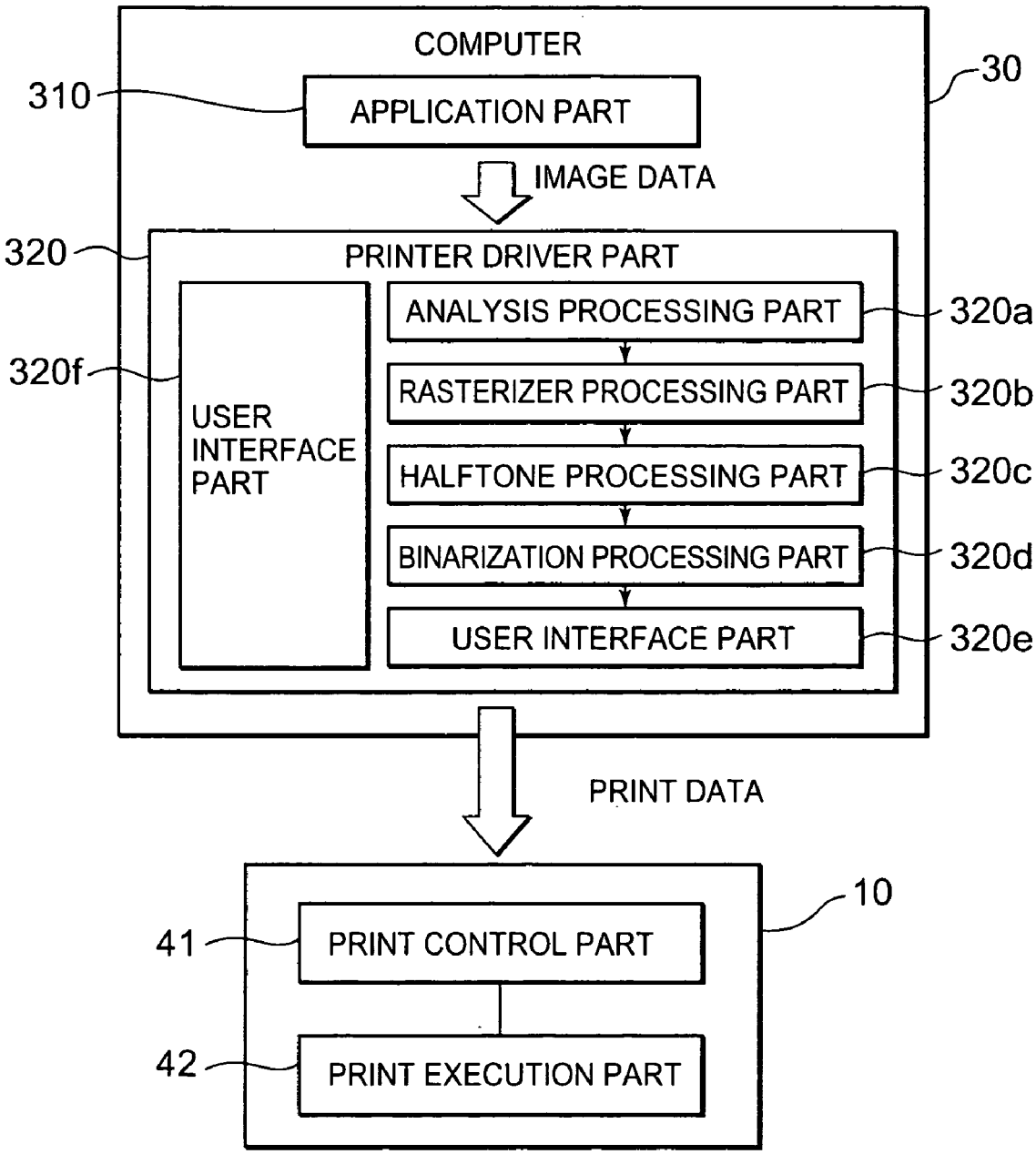
FIG. 3 is a block diagram showing a functional configuration of a printing system.

As seen in FIG. 3, a print control part 41 and a print execution part 42 are implemented on the printer 10.

The print control part 41 interprets print data sent from the computer 30 and controls execution of printing in the printer 10 based on the print data.

The print execution part 42 executes printing of the print medium by the print engine 15 according to instructions fed from the print control part 41.

Next, processing operation of the print system applied with the present invention will be described herein after.

First, a processing operation when the printer driver part 320 receives a print setting request from a user will be described.

Figure 4:
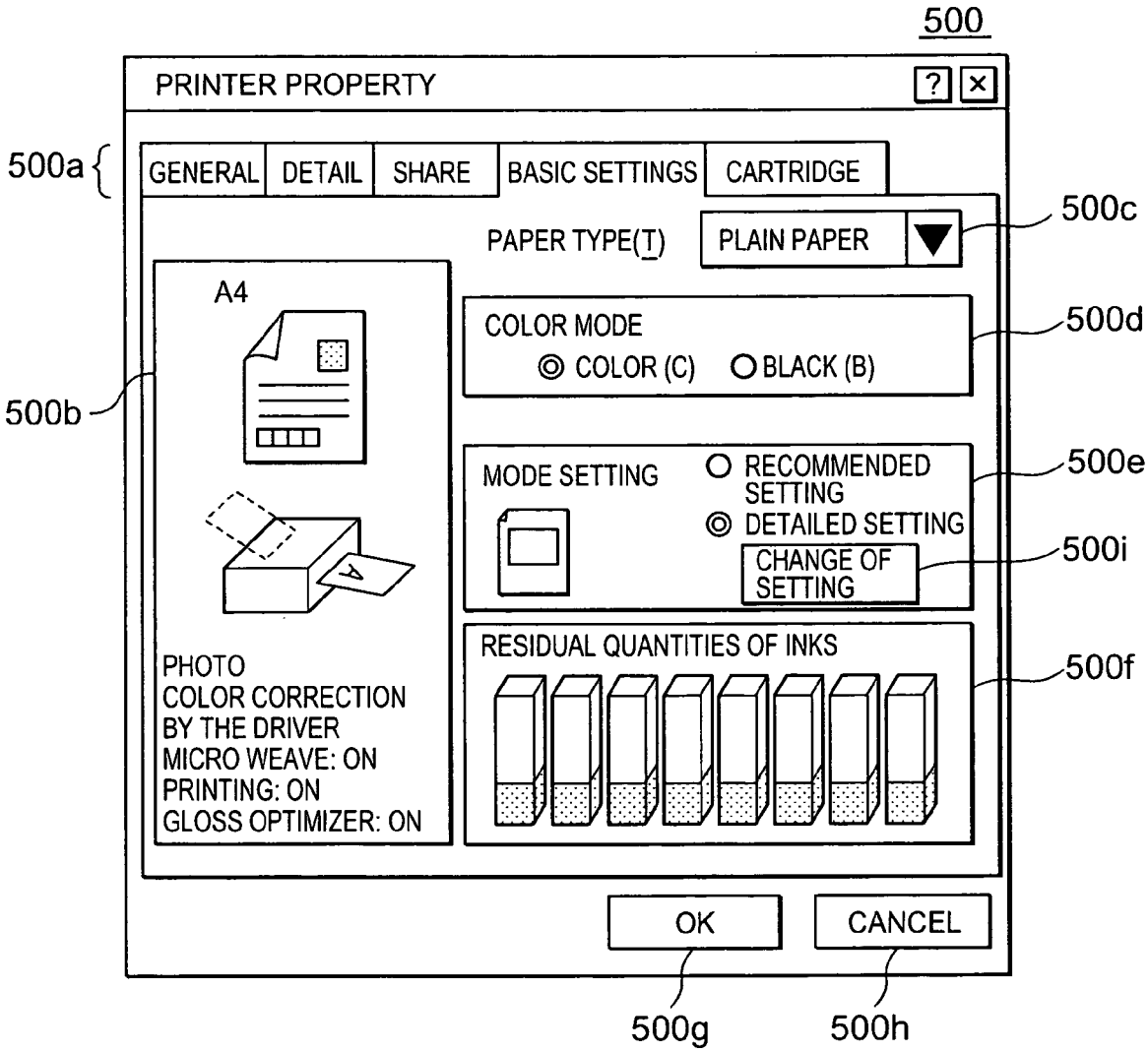
FIG. 4 is a view showing a print setting screen.

When the user interface part 320*f* of the printer driver part 320 receives a print setting request from a user through, for example, a menu command provided by the application part 310, then the user interface part 320 displays a print setting screen 500, an example of which is shown in FIG. 4, on the display unit 21, to receive print setting from the user.

As shown in the figure, the print setting screen 500 is a screen for setting basic contents relating to print setting, and can set, for example, a paper type 500*c*, a color mode 500*d*, a print mode 500*e*, and the like. Here, the paper type 500*c* can be set by selecting, for example, plain paper, glossy paper, or the like from a menu. The ink mode 500*d* can designate either color printing or monochrome printing. The mode setting 500*e* can designates whether printing is performed according to recommended setting that does not require detailed setting or according to detailed setting. Here, by selecting the detailed setting, a detailed setting related to print quality may be defined. This will be described later.

Further, the print setting screen 500 has: a tab part 500*a* for displaying setting screens for other items relating to printing; a column 500*b* for displaying the size and direction of printing; a column for displaying residual quantities of the inks of the printer 10; an "OK" button 500*g* for reserving the content of the setting; and a "Cancel" button 500*h* for canceling the content of the setting.

Figure 5:
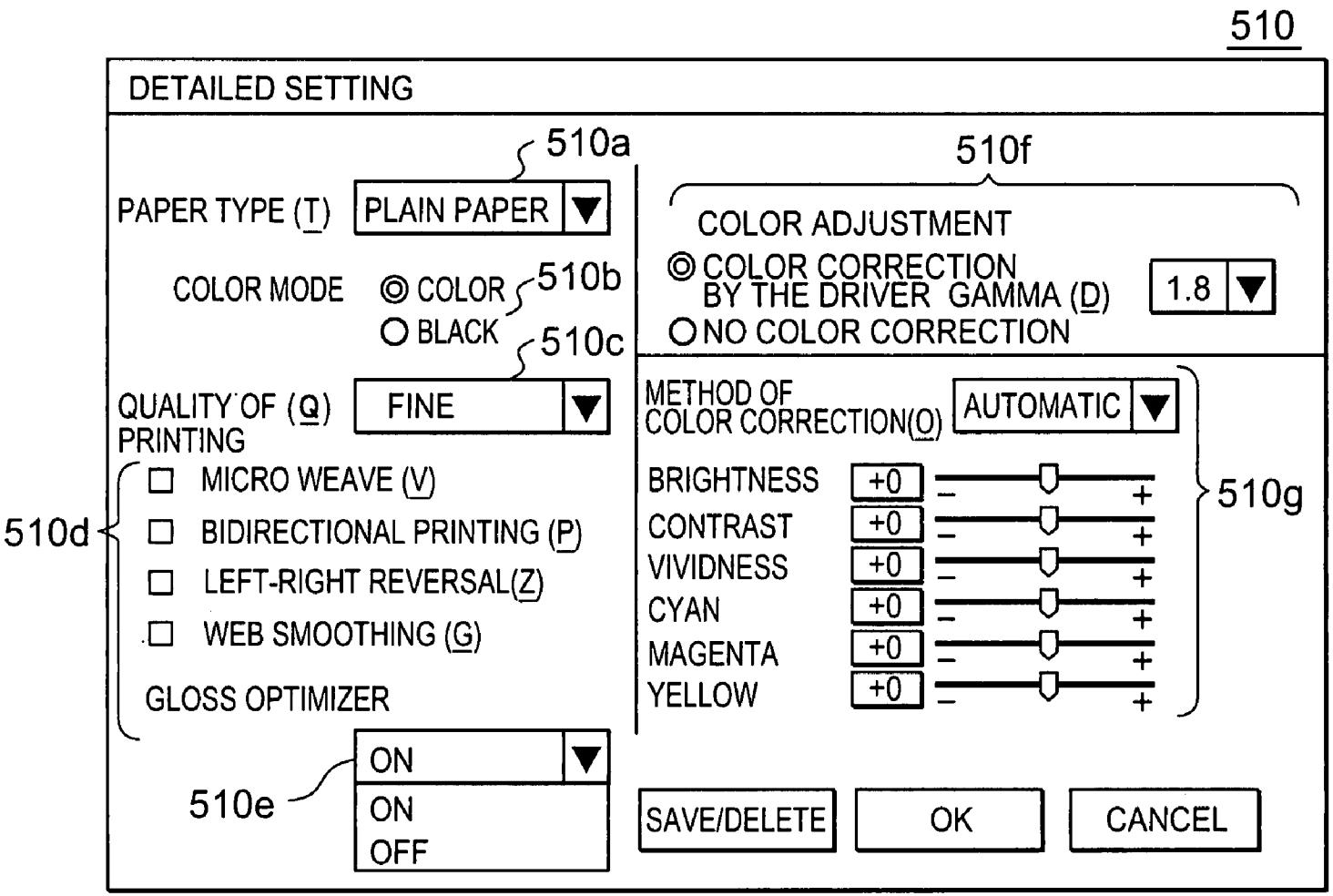
FIG. 5 is a view showing a detailed setting screen.

When the detailed setting is selected in the mode setting 500*e* and a click of a "Detailed setting" button 500*i* is received, then the user interface part 320*f* of the printer driver part 320 displays a detailed setting screen 510, an example of which is shown in FIG. 5, on the display unit 21, to receive detailed setting from the user.

In the detailed setting screen 510, the user can set details of a paper type 510*a*, a color mode 510*b*, print quality 510*c*, a printing method 510*d*, color adjustment 510*f* and color correction 510*g*.

In the present embodiment, the printing method 510*d* includes gloss optimizer setting 510*e*. The gloss optimizer setting 510*e* is a column for receiving setting as to whether the clear ink should be used in printing and, in the case of use, how the clear ink should be used.

For example, it may be arranged such that the gloss optimizer setting 510*e* can be set to either "OFF" meaning that the clear ink is not used or "ON" meaning that the clear ink is used in an area onto which the black or color inks have been jetted out. When a user designates "ON", it is possible to increase the chroma of printed colors and to increase abrasion resistance of the printed area.

Or, it may be arranged such that the gloss optimizer setting 510*e* can be set to one of "OFF", "ON (automatic)" and "ON (entire surface)". Here, "ON (automatic)" indicates jetting out and superimposing the clear ink in an area of image data when the subject for printing is dot image data (data of a set of dots, for example, photographic image data). On the other hand, "ON (entire surface)" indicates that the clear ink is jetted out onto the entire surface of a printable area. In both cases, it is possible to eliminate lack of uniformity in the gloss. In the case where "ON (automatic)" is selected, it is possible to eliminate lack of uniformity in dot image data where lack of uniformity in the gloss is more conspicuous than character data, draw data and the like, while suppressing consumption of the clear ink.

It may be arranged such that choices selectable as the gloss optimizer setting 510*e* depend on contents of settings of the paper type 510*a*, the print quality 510*c*, and the like.

Figure 6:
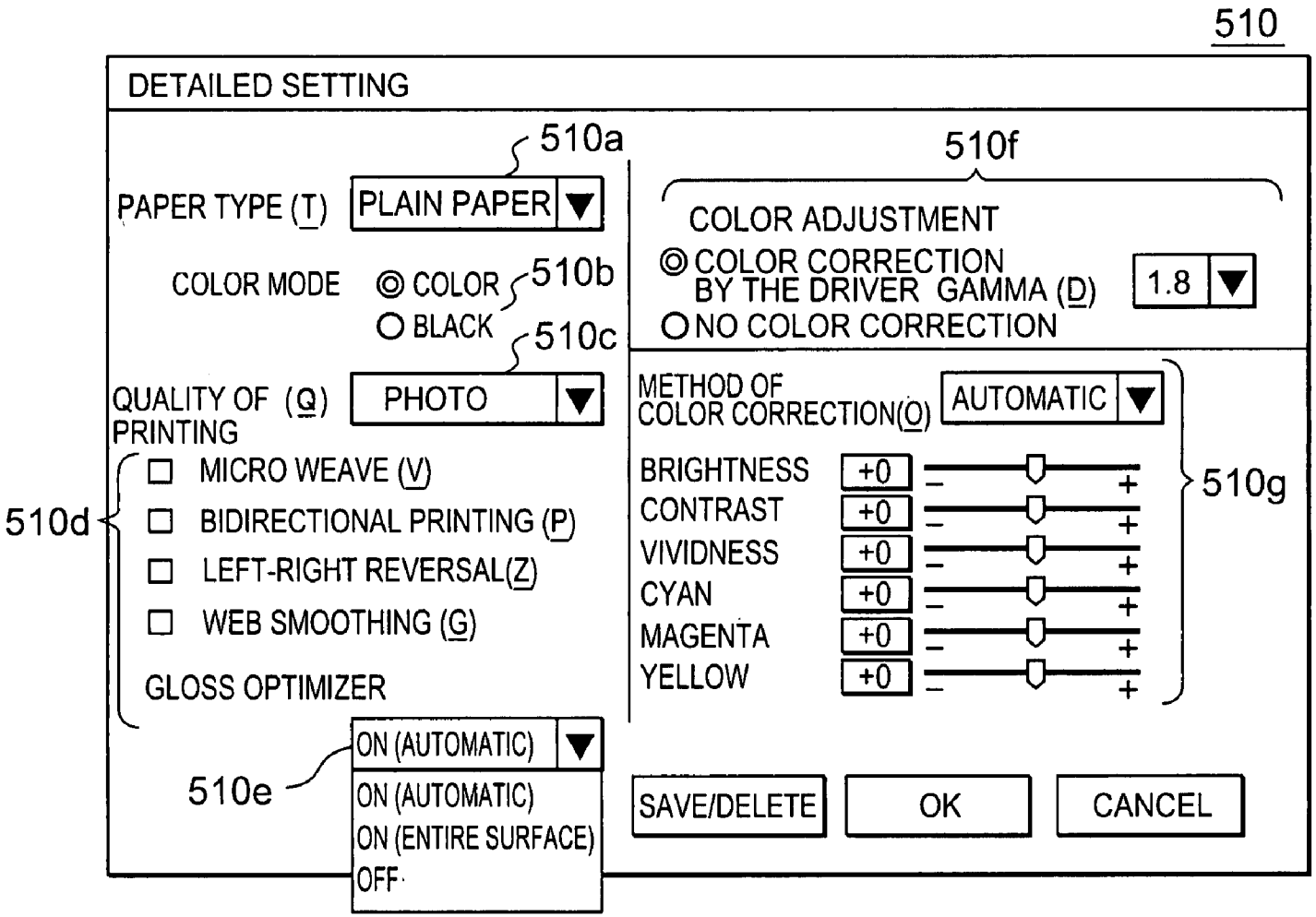
FIG. 6 is a view showing a detailed setting screen.

For example, it may be arranged such that, when the "plain paper" is designated as the paper type 510*a* and high quality printing is designated as the print quality 510*c*, then, as shown in FIG. 5, the gloss optimizer setting 510*e* can be set to either "ON" or "OFF", and on the other hand, when the "glossy paper" is designated as the paper type 510*a*, then, as shown in FIG. 6, the gloss optimizer setting 510*e* can be set to one of "ON (automatic)", "ON (entire surface)" and "OFF".

Further, when "plain paper" is designated as the paper type 510*a* and draft printing is designated as the print quality 510*c*, then the gloss optimizer setting 510*e* may be fixed to "OFF".

In other words, it may be arranged as follows. Namely, when it is expected from the contents of the print setting that higher quality printing is to be performed, use of the clear ink can be designated in detail. When it is expected that medium quality printing is to be performed, the gloss optimizer setting 510*e* can be set to either "ON" or "OFF". And when it is expected that quality of printing is not important, then the gloss optimizer setting 510*e* is fixed to "OFF" without using the clear ink. Consequently, the use of clear ink could be optimized.

Modes for applying the clear ink are not limited to "ON", "ON (entire surface)" and "ON (automatic)", however, various modes can be considered.

For example, it is possible to employ a mode in which the clear ink is jetted out onto white parts of a dot image data area. Here, the white parts are ground parts of paper, onto which the other inks are not jetted out. In that case, inks are jetted out onto the entire area of the image data, and thus lack of uniformity in the gloss can be eliminated in the dot image data area, with the minimum necessary consumption of the clear ink.

Or, it is possible to employ and designate a mode in which, out of the entire surface of a print area, the clear ink is jetted out onto ground parts of paper, onto which the other inks are not jetted out. In that case, lack of uniformity in the gloss can be eliminated for the entire print area.

Further, as a variant of "ON (automatic)" in which the clear ink is jetted out superimposing the dot image data area, it is possible to employ a mode in which the clear ink is jetted out onto a slightly larger area than the dot image data.

Figure 7:
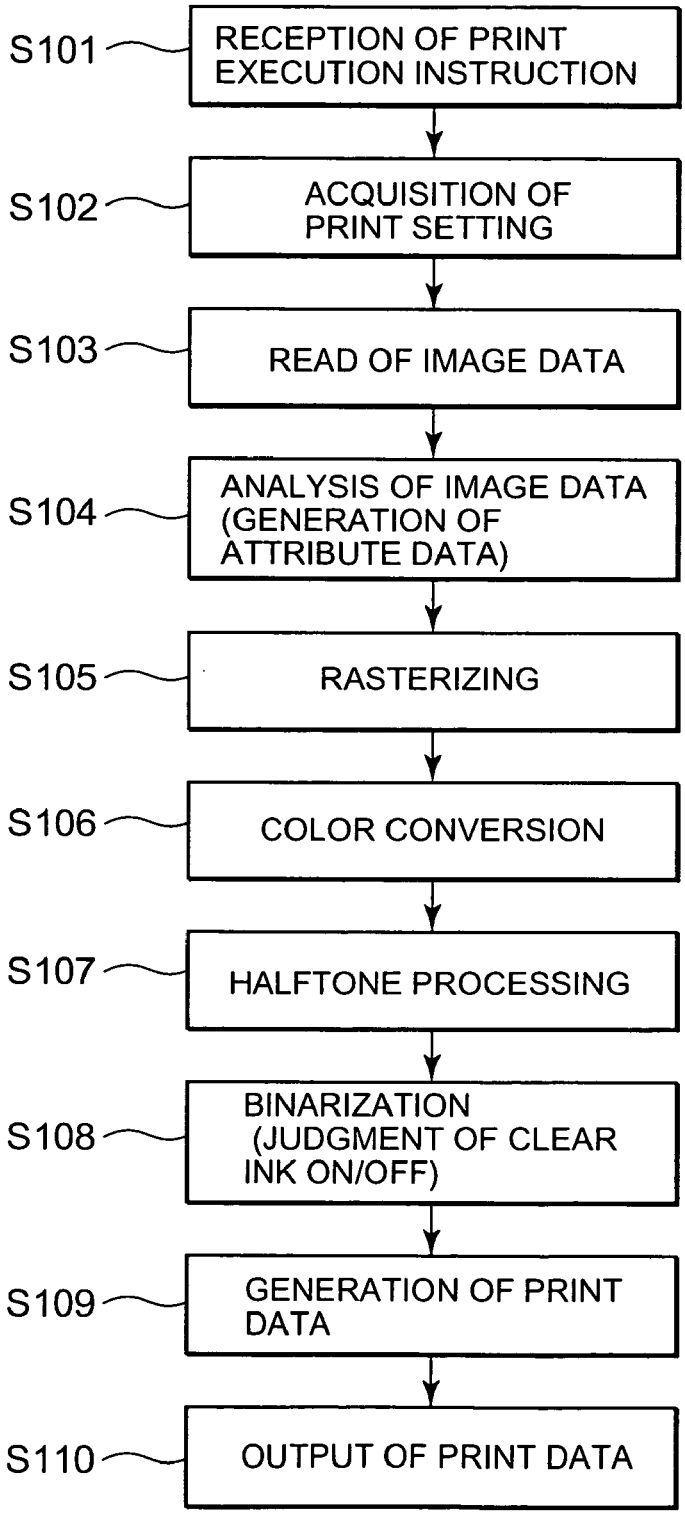
FIG. 7 is a flowchart for explaining print processing of a printer driver part.

Next, referring to a flowchart of FIG. 7, will be described pint processing in the printer driver part 320 in the case where the gloss optimizer setting 510*e* designates use of the clear ink. In the case where use of the clear ink is not designated, print processing similar to the conventional processing without using clear ink is performed.

When the printer driver part 320 receives a print execution instruction from the user (S101), the printer driver part 320 acquires contents of the print setting received through the print setting screen 500, the detailed setting screen 510 and the like (S102).

Then, the printer driver part 510 reads a print object, i.e., image data generated by the application part 510 (S103). Usually, the image data are read in prescribed units referred as bands, and then subjected to processing described in the following.

The analysis processing part 320*a* of the printer driver part 320 analyzes what data are included in the image data as the processing object (S104). The analysis result is expressed in data referred as attribute data. The attribute data includes information indicating in which part of the print area the dot image data exist, and other information.

Next, the rasterizer processing part 320*b* of the printer driver part 320 rasterizes the image data as the processing object (S105). Resolution and the like at the time of rasterizing are determined based on the contents of the print setting.

Further, the halftone processing part 320*c* converts color expression of the RGB format into color expression of CMY format (S106). Further, the halftone processing part 320*c* performs halftone processing so that the converted colors are expressed by the black and color inks mounted on the printer 10 (S107).

Then, the binarization processing part 320*b* performs binarization processing in which a color of each dot in the print area is converted into ON-OFF of jetting of the black and color inks (S108).

In this processing, the binarization processing part 320*b* also judges ON-OFF of jetting of the clear ink for each dot. This judgment is made as follows based on the setting of the gloss optimizer 510*e* received through the detailed setting screen 510.

Namely, in the case where "ON" is designated, meaning that the clear ink is to be jetted out superposing the place of which the black or color inks have been jetted, then the clear ink is made ON with respect to each dot for which at least one of the black and color inks is ON. On the other hand, the clear ink is made OFF with respect to each dot for which all the black and color inks are OFF.

Further, in the case where "ON (automatic)" is designated, meaning that the clear ink is to be jetted out superimposing the dot image data area, then, referring to the attribute data generated in the processing (S104), the dot image data area is acquired and the clear ink is made ON with respect to the dots included in that area.

Further, in the case where "ON (entire surface)" is designated, meaning that the clear is to be jetted out onto the entire surface of the print area, then the clear ink is made ON with respect to any dot that can be printed.

Further, in the case where the setting is designated such that the clear ink is to be jetted out onto white parts of the dot image data area, then, referring to the attribute data, the dot image data area is acquired and the clear ink is made ON with respect to each for which all the black and color inks are OFF among the dots included in the image data.

Also in the case of other settings, it is possible to judge ON-OFF of jetting of the clear ink based on ON-OFF of the black and color inks, the attribute data, and the like.

The command conversion processing part 320*e* of the printer driver part 320 generates print data for controlling the printer 10, based on ON-OFF of each ink for each dot (S109).

Then, the printer driver part 320 outputs the generated print data to the printer 10, to end the print processing.

When the printer 10 executes printing based on the print data sent from the computer 30, high quality printing using the clear ink is realized.

According to the above embodiment, in the mode in which the clear ink is jetted out onto white parts (i.e., paper ground parts onto which the other inks are not jetted out) of a dot image data area and in the mode in which the clear ink is jetted out onto paper ground parts of the entire surface of a print area, onto which the other inks are not jetted out, lack of uniformity in the gloss in those areas is prevented by jetting out the clear ink onto the parts onto which the other inks are not jetted out, to create a state in which some ink has been jetted out onto the image data area or the whole print area.

In these cases, similar effects can be obtained by applying a white ink instead of the clear ink.

Namely, parts onto which no ink is jetted out shows a white color. i.e., the ground color of printing paper. Thus, by jetting out a white ink onto those parts, it is possible to create a state in which some ink has been jetted out onto the dot image data area or the whole print area, and thus it is possible to prevent lack of uniformity in the gloss in the image data area or the whole print area.

Hereinabove, examples where a clear ink or a white ink is used in an ink-jet printer are described. However, the present invention can be applied to a laser beam printer, using a clear toner or a white toner.

As described above, according to the present invention, print quality can be easily improved without carrying out surface finishing after printing.

What is claimed is:

1. A printer that prints an image based on image data, on a print medium, using a plurality of color inks, comprising:

a colorless clear ink printing part which prints the print medium using a colorless clear ink;

a print setting receiving part which receives settings relating to printing including a setting relating to a type of the print medium and a quality of printing; and an area determination part which determines an area for applying the colorless clear ink based on the setting relating to a type of the print medium and the quality of printing.

2. A printer according to claim 1, wherein:

said colorless clear ink is a pigment ink whose composition includes a resin component and excludes a color component.

3. A printer according to claim 1, wherein:

composition of said colorless clear ink includes fine particles of polymer and excludes a color agent.

4. A printer according to claim 3, wherein:

said polymer is one of: polymers containing a sulfonic group (sol-type resins); modified polypropylene emulsions; copolymers obtained by polymerizing ethyleny unsaturated carboxylic acid monomers and other monomers that can be copolymerized with said monomers, in the presence of a water-soluble high molecular compound containing an alcoholic hydroxyl group or a copoylymerizable surface active agent; and emulsifiable resins having a particle diameter of 70 nm or more.

5. A print control unit that outputs print data to a printer that prints an image based on print data, on a print medium, using a plurality of color inks and a colorless clear ink, wherein:

said print control unit comprises:

a print setting receiving part which receives settings relating to printing including a setting relating to a type of the print medium and a quality of printing; and a print data generation part which generates print data based on image data; and said print data generation part determines an area for applying the colorless clear ink based on the setting relating to a type of the print medium and the quality of printing.

6. A print control method in a computer connected to a printer that prints an image based on print data, on a print medium, using a plurality of color inks and a colorless clear ink, wherein:

said print control method comprises:

an image data input step in which image data are inputted;

a print setting receiving step in which settings relating to printing are received; and a print data generation step in which print data to be outputted to said printer are generated based on the image data; and said print data generation step determines an area for applying the colorless clear ink based on at least one of said image data and said settings relating to printing;

wherein said print setting receiving step further accepts a setting relating to a type of the print medium and quality of printing and changes a setting relating to an area for applying the colorless clear ink in accordance with the received type of the print medium and the received quality of printing.

7. A print control method according to claim 6, wherein:

said print setting receiving step may accept a setting that defines printing without using the colorless clear ink.

8. A print control method according to claim 6, wherein:

said print setting receiving step may accept a setting that defines printing an area for applying the colorless clear ink in place of the area for applying the color inks.

9. A print control method according to claim 6, wherein:

said print setting receiving step may accept a setting that defines printing by which an entire surface of a printable area is the area for applying the colorless clear ink.

10. A print control method according to claim 6, wherein:

said print setting receiving step may accept a setting that defines printing by which an area corresponding to dot image data in said image data is the area for applying the colorless clear ink.

11. A print control method according to claim 6, wherein:

said print setting receiving step may accept a setting that defines printing by which an area that corresponds to dot image data in said image data and does not use the color inks is the area for applying the colorless clear ink.

12. A print control method according to claim 6, wherein:

said print setting receiving step may accept a setting that defines printing by which, when the print medium is a plain paper, an area where the color inks are used is the area for applying the colorless clear ink.

13. A print control method according to claim 6, wherein:

said print setting receiving step may accept a setting that defines printing by which, when the print medium is a glossy paper, an area corresponding to dot image data in said image data is the area for applying the colorless clear ink.

14. A print control program product executed by a computer connected to a printer that prints an image based on print data, on a print medium, using a plurality of color inks and a colorless clear ink, wherein:

said programs makes said computer function as:

an image data input part which inputs image data;

a print setting receiving part which receives settings relating to printing including a setting relating to a type of the print medium and a quality of printing; and a print data generation part which generates print data to be outputted to said printer, based on the image data, and said print data generation part determines an area by which the colorless clear ink is used, based on the setting relating to a type of the print medium and the quality of printing.

* * * * *